US011000083B2

(12) United States Patent
Visokey

(10) Patent No.: US 11,000,083 B2
(45) Date of Patent: May 11, 2021

(54) GARDEN GLOVE

(71) Applicant: Kim K. Visokey, Winnetka, IL (US)

(72) Inventor: Kim K. Visokey, Winnetka, IL (US)

( * ) Notice: Subject to any disclaimer, the term of this patent is extended or adjusted under 35 U.S.C. 154(b) by 0 days.

(21) Appl. No.: 15/918,433

(22) Filed: Mar. 12, 2018

(65) Prior Publication Data

US 2018/0263315 A1 Sep. 20, 2018

Related U.S. Application Data

(63) Continuation-in-part of application No. 14/864,337, filed on Sep. 24, 2015, now abandoned.

(60) Provisional application No. 62/054,717, filed on Sep. 24, 2014.

(51) Int. Cl.
*A41D 19/00* (2006.01)
*A41H 43/00* (2006.01)

(52) U.S. Cl.
CPC ..... *A41D 19/0058* (2013.01); *A41D 19/0024* (2013.01); *A41D 19/0068* (2013.01); *A41D 19/0082* (2013.01); *A41D 19/0096* (2013.01); *A41H 43/00* (2013.01); *A41D 2400/80* (2013.01); *A41D 2500/50* (2013.01); *A41D 2600/20* (2013.01)

(58) Field of Classification Search
CPC ..... A41D 19/0075; A41D 19/01594; A41D 19/0058; A41D 19/01523; A41D 19/01558; A41D 19/01505; A63B 31/02
USPC ..... 2/161.1
See application file for complete search history.

(56) References Cited

U.S. PATENT DOCUMENTS 1,346,683 A * 7/1920 Reynolds ..... A41D 19/0065 2/161.8
4,669,991 A * 6/1987 Southworth ..... A63B 31/04 441/57
6,654,965 B2 * 12/2003 Hochmuth ..... A63B 71/148 2/161.1
6,772,441 B2 * 8/2004 Lucas, Jr. ..... A41D 19/01582 2/161.1
8,239,969 B2 * 8/2012 Fisher ..... A63B 71/141 2/161.1
2001/0044950 A1 * 11/2001 Sajovic ..... A41D 19/01547 2/161.8
2002/0043810 A1 * 4/2002 Dooley ..... A01K 23/005 294/1.3
2005/0160516 A1 * 7/2005 Price ..... A41D 19/01558 2/161.6
2005/0268374 A1 * 12/2005 Mattesky ..... A41D 19/01547 2/164
2007/0039083 A1 * 2/2007 Williams ..... A41D 19/0003 2/16
2008/0120754 A1 * 5/2008 Raymond ..... A41D 19/01529 2/16
2008/0282445 A1 * 11/2008 Taliento ..... A41D 19/01523 2/161.3
2009/0139008 A1 * 6/2009 Drab ..... A63B 71/146 2/161.3
2009/0139010 A1 * 6/2009 Bevier ..... A63B 71/148 2/161.8

(Continued)

*Primary Examiner* — Jillian K Pierorazio
(74) *Attorney, Agent, or Firm* — Cook Alex Ltd.; R. Blake Johnston

(57) ABSTRACT

A garden glove features a body formed from two pieces of material that are sewn together to include a number of finger portions. Webs extend between the finger portions and are delineated from the finger portions by stitching.

10 Claims, 20 Drawing Sheets

(56) References Cited

U.S. PATENT DOCUMENTS

| | | | | |
|---|---|---|---|---|
| 2009/0183294 | A1* | 7/2009 | Lucas, Jr. | A41D 19/01523 2/161.1 |
| 2012/0324623 | A1* | 12/2012 | Cabauy | A41D 19/01558 2/167 |
| 2013/0061368 | A1* | 3/2013 | Filippone | A63B 71/143 2/160 |
| 2014/0189925 | A1* | 7/2014 | Ramirez | A41D 19/01547 2/16 |
| 2015/0040288 | A1* | 2/2015 | Gaff | A41D 19/01564 2/161.1 |
| 2015/0189932 | A1* | 7/2015 | Champagne | A41D 13/08 2/161.6 |
| 2016/0058083 | A1* | 3/2016 | Palese | A41D 19/01529 2/16 |
| 2016/0095368 | A1* | 4/2016 | Tidridge | A01K 97/14 2/161.5 |
| 2018/0043232 | A1* | 2/2018 | Perry | A63B 71/148 |

* cited by examiner

GARDEN GLOVE

CLAIM OF PRIORITY

This application is a continuation-in-part of U.S. patent application Ser. No. 14/864,337, filed Sep. 24, 2015, which claims the benefit of U.S. Provisional Patent Application No. 62/054,717, filed Sep. 24, 2014, the contents of each of which are hereby incorporated by reference.

FIELD OF THE INVENTION

The present invention relates generally to gloves and, in particular, to a garden glove adapted for digging, scooping and/or carrying dirt.

BACKGROUND

Gloves are typically worn by gardeners to protect their hands while working in the garden or during container gardening. Often gardeners will need to dig holes, trenches or the like in the ground or container and scoop or otherwise move dirt, mulch or the like. Gardeners typically use hand tools such as trowels, transplanters, cultivators and the like to perform such tasks. A disadvantage of such an approach, however, is that the gloves may make it difficult to hold and manipulate the tool. In addition, the tools must be carried to and from the garden and be accessible. This may be particularly tedious as a gardener moves around the garden.

A need exists for a glove that may be used as a garden glove and a tool for digging, scooping and/or carrying dirt, mulch and the like during gardening or container gardening.

DETAILED DESCRIPTION OF EMBODIMENTS

Figure 1A:
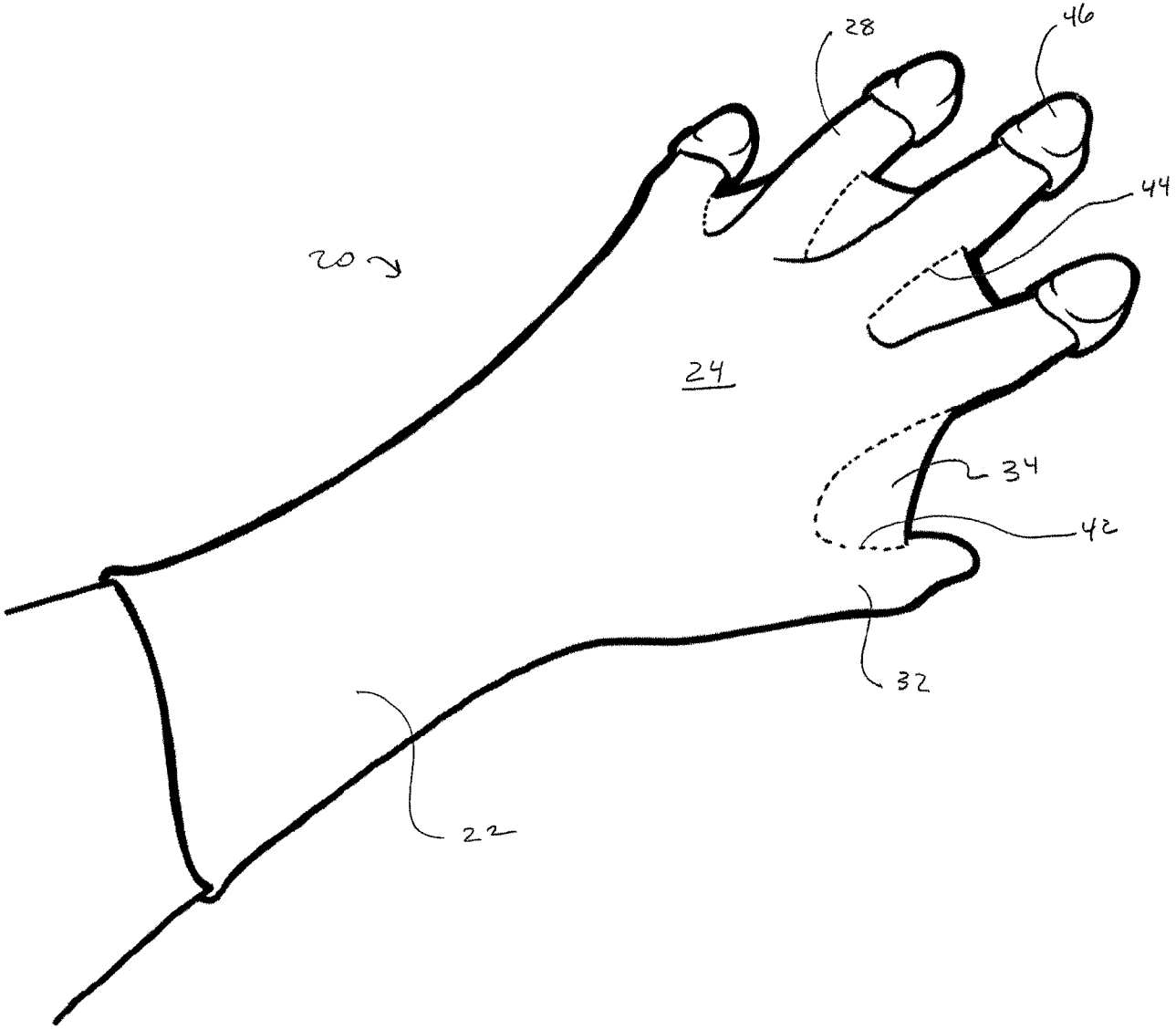
FIGS. 1A and 1B are top and bottom perspective views, respectively, of a first embodiment of the garden glove of the invention.
Figure 1B:
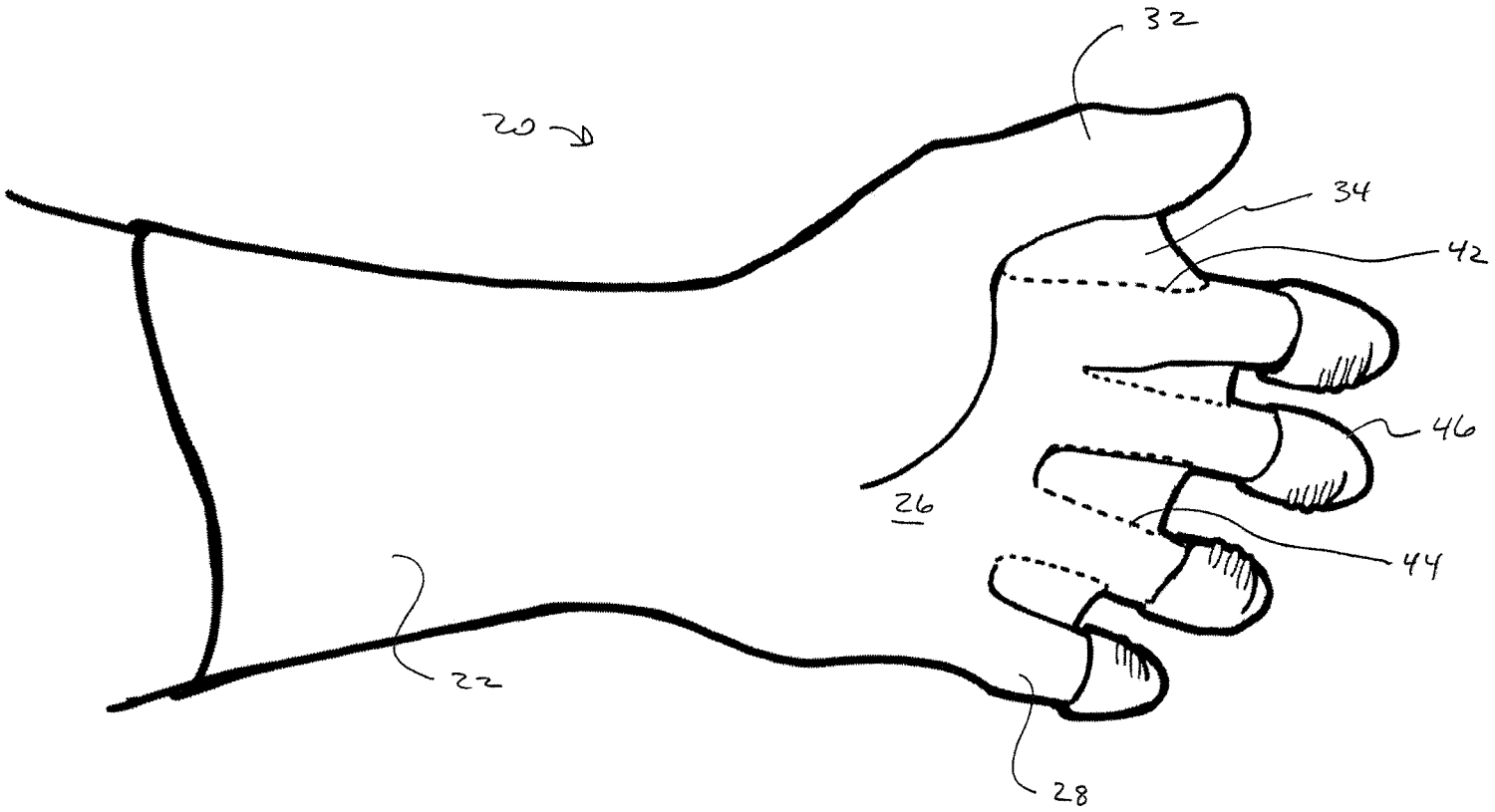

An embodiment of the garden glove of the present invention is indicated in general at 20 in FIGS. 1A and 1B. The glove features a body having a cuff portion 22, a back of hand portion 24, a palm portion 26, finger portions 28 and a thumb portion 32. Extending between each of the finger portions 28 and the thumb portion 32 are flexible webs 34. The glove 20 may be formed from any material known in the art for creating gloves including, as examples only, fabric made from natural (such as cotton) or man-made fibers, rubber or flexible plastic. In the embodiment shown in FIGS. 1A and 1B, the cuff, back of hand, palm, finger and thumb portions and webs are formed by a cut and sew method using, for example, two or more pieces of material sewn together as is known in the art. In addition, the glove is provided with stitching 42 and 44 whereby the finger and thumb portions are formed with the webs there between. As described below, other methods may be used to construct alternative embodiments of the garden glove.

As indicated at 46 in FIGS. 1A and 1B, the distal end of each finger portion 28 is provided with a fingertip cover. The fingertip covers, as explained in greater detail below, are adapted to enhance the wearer's ability to dig and grasp objects using their fingertips.

As an example only, the fingertip covers 46 may be formed of nitrile or latex, with the glove fingertips dipped into such material and molded or otherwise shaped prior to hardening. As another example, the fingertip covers may be pre-formed, such as being molded from plastic, rubber or other durable material and then secured onto the glove fingertips using adhesive or fasteners. As still another alternative, the fingertip covers may be sewn onto the glove fingertips or secured to the glove fingertips by a combination of glue and sewing. Examples of suitable materials for the fingertip covers include, but are not limited to, acrylonitrile butadiene styrene (ABS), thermoplastic rubber (TPR), nylon (such as nylon 6) and polycarbonate.

Figure 2A:
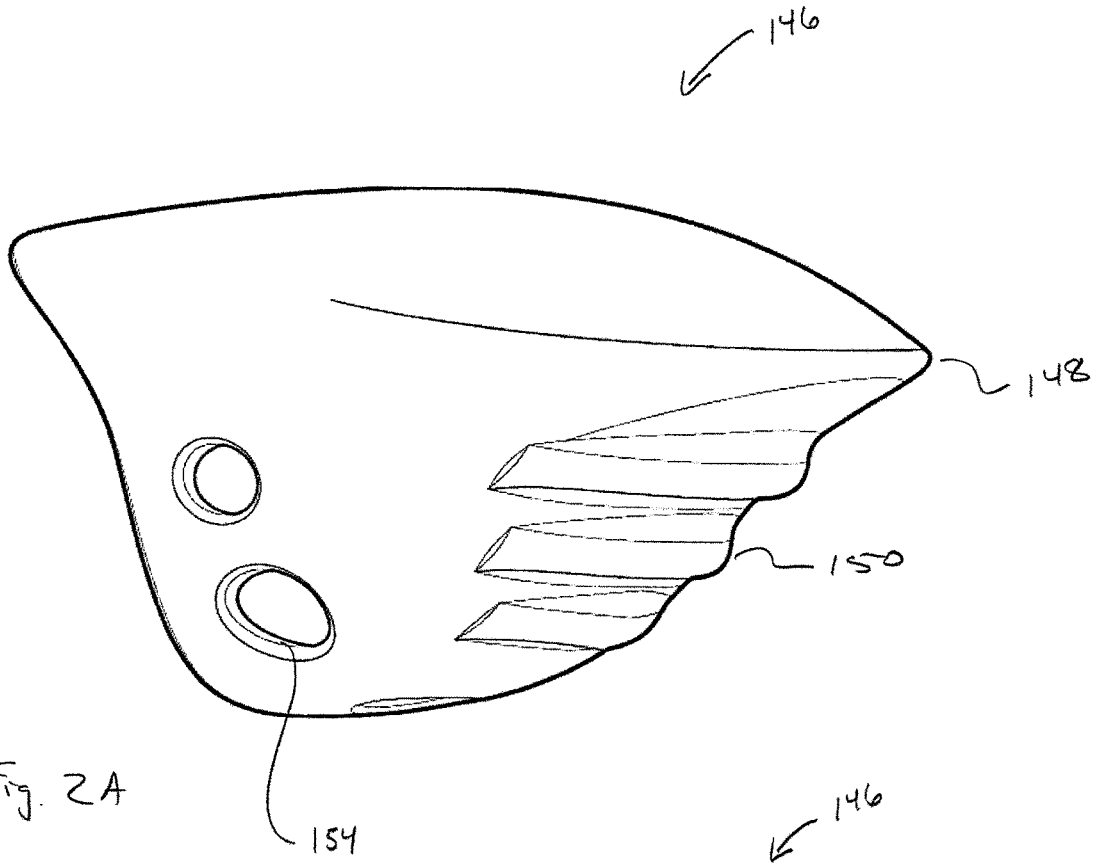
FIGS. 2A and 2B are side and front perspective views, respectively, of a first embodiment of the fingertip covers of the garden glove of the present invention.
Figure 2B:
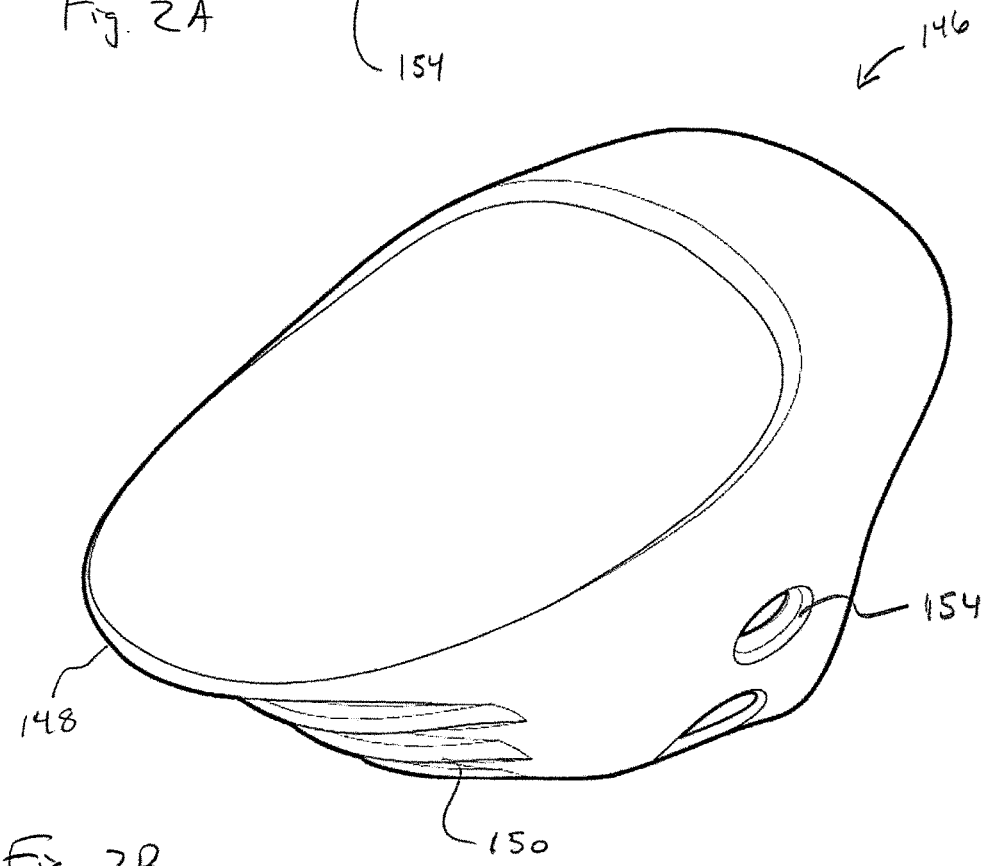
Figure 3:
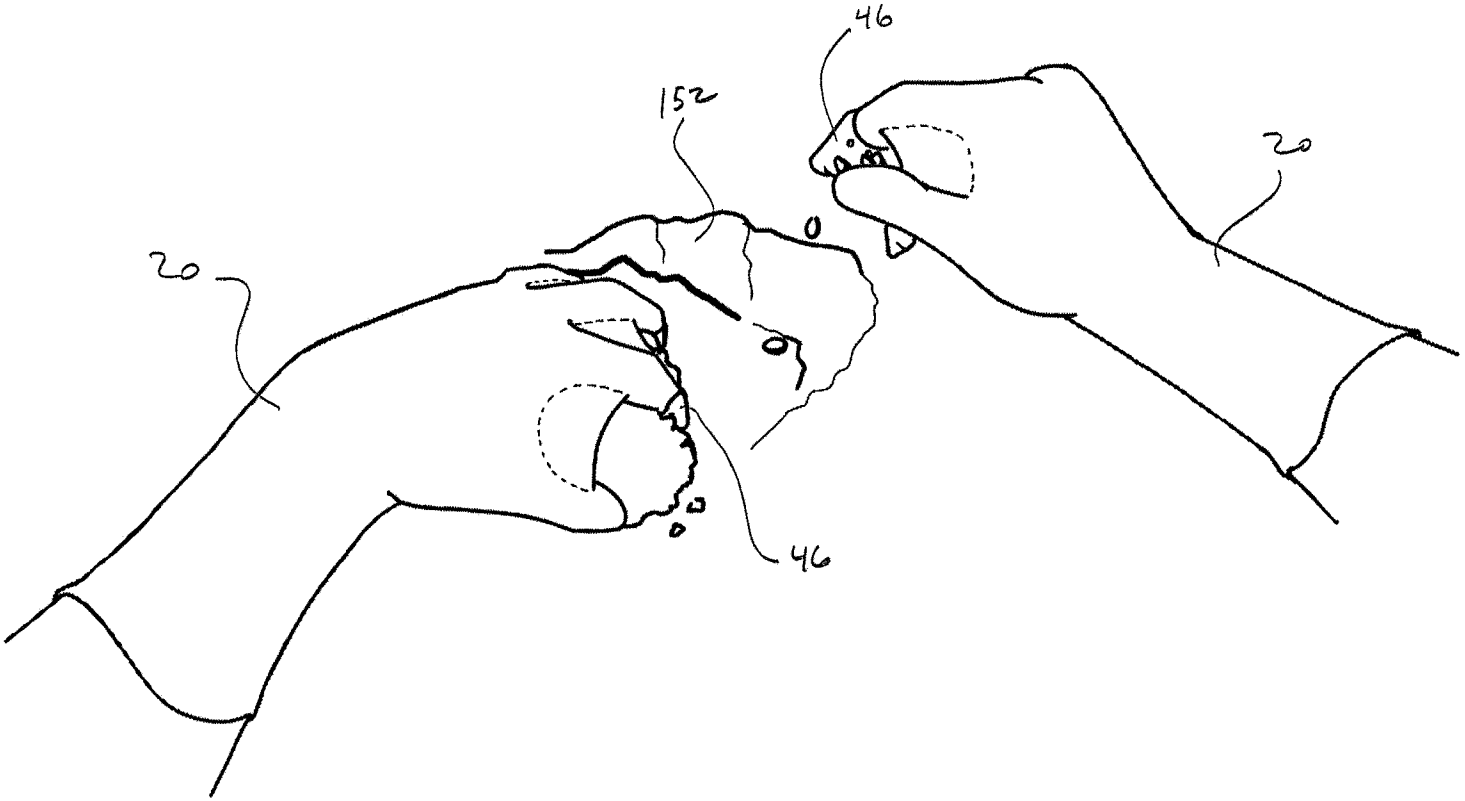
FIG. 3 shows the garden glove of FIGS. 1A and 1B being used for digging.

In an embodiment of the fingertip covers 46 of FIGS. 1A and 1B, indicated in general at 146 in FIGS. 2A and 2B, the fingertip cover is hollow with an opening on the back to receive the fingertip of a corresponding glove finger portion. The fingertip cover features a digging tip 148 with a number of ribs 150 positioned under the digging tip. The digging tip 148 and ribs 150 permit digging when the wearer's hands are formed into a "clawing" position, such as illustrated in FIG. 3. More specifically, the digging tips 148 of the glove are shaped so as to travel into dirt, mulch or the like 152 as the wearer digs. The ribs 150 aid the fingers in withdrawing the dirt, mulch or the like from the hole or channel being formed by the wearer.

The ribs 150 also allow a wearer to more easily grip items using his or her fingertips in that they reduce the chance of slippage.

As shown in FIGS. 2A and 2B, the fingertip cover 146 may be formed with openings 154 which enable the cover to be sewn to a glove fingertip/distal end portion or secured to the glove fingertip using fastener(s).

Figure 4:
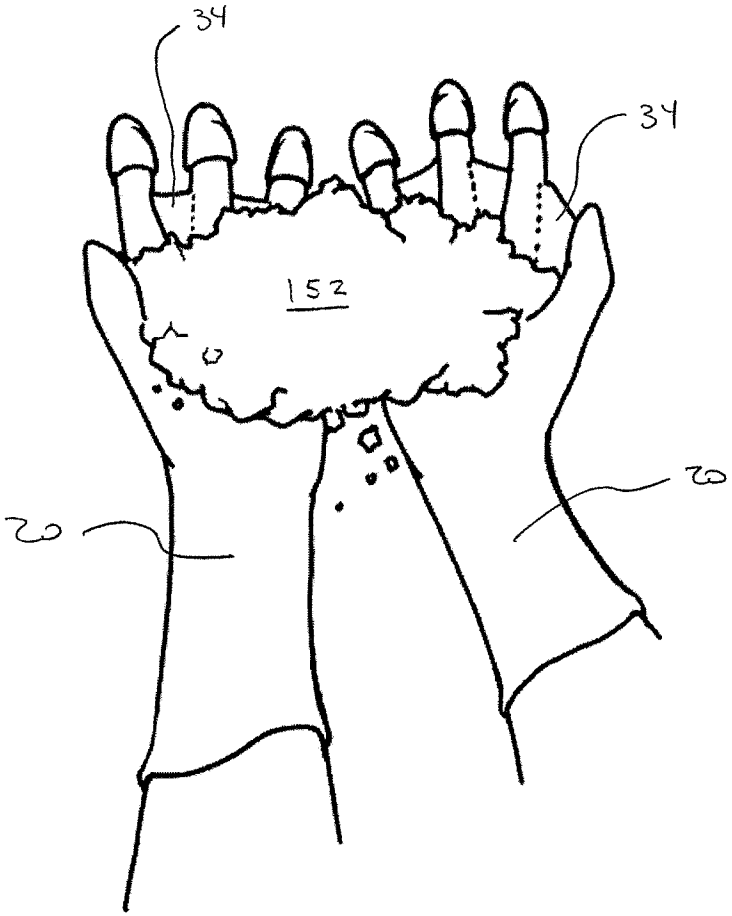
FIG. 4 shows the garden glove of FIGS. 1A, 1B and 3 being used for carrying dirt.

With reference to FIG. 4, the flexible webs 34 of the gloves 20 enable the user to scoop and carry dirt, mulch or the like 152 so that the gloved hands of the wearer effectively form flexible trowels, especially when combined with the fingertip covers.

Figure 5A:
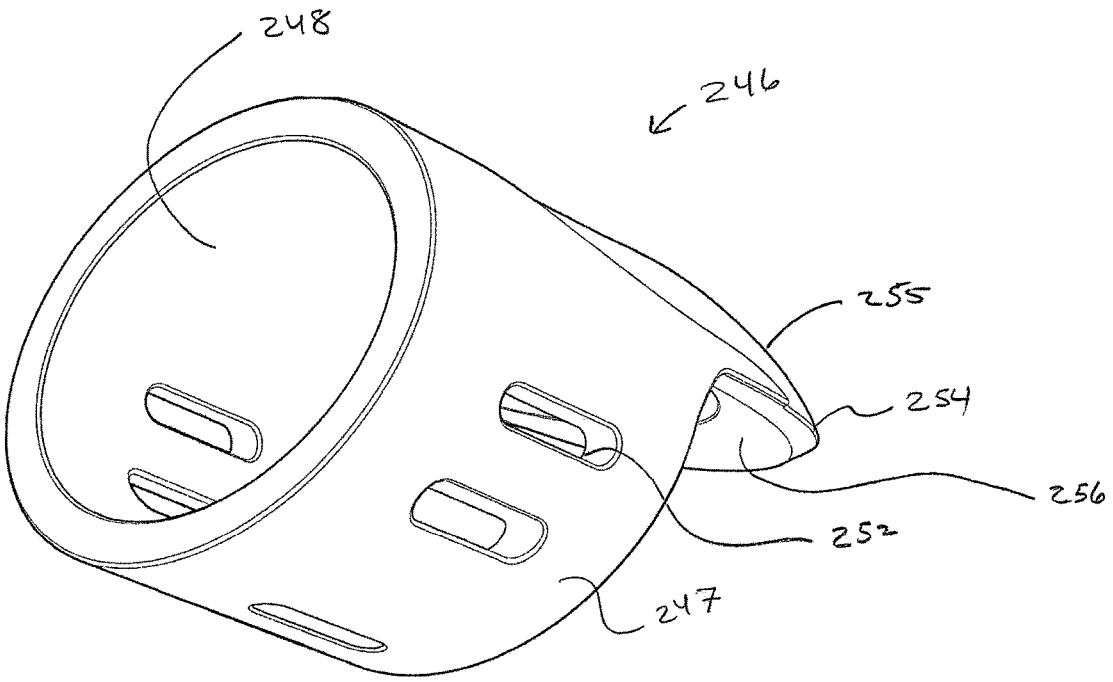
FIGS. 5A-5C are back, top and front perspective views, respectively, of a second embodiment of the fingertip covers of the garden glove of the present invention.
Figure 5B:
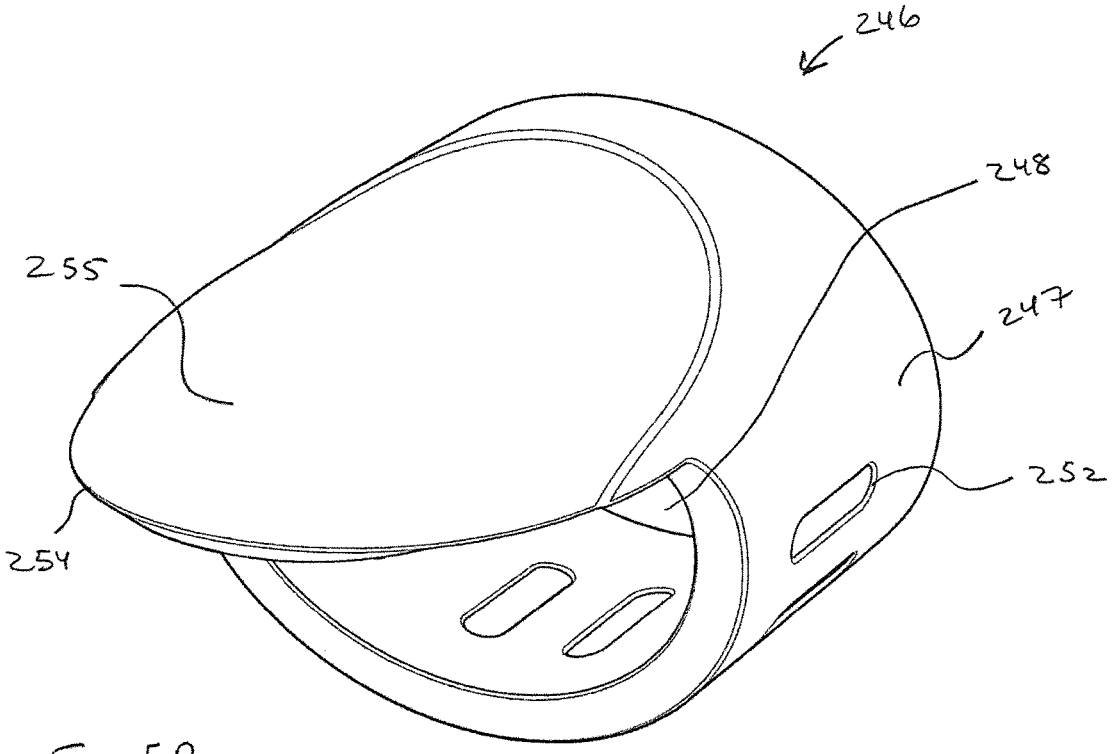
Figure 5C:
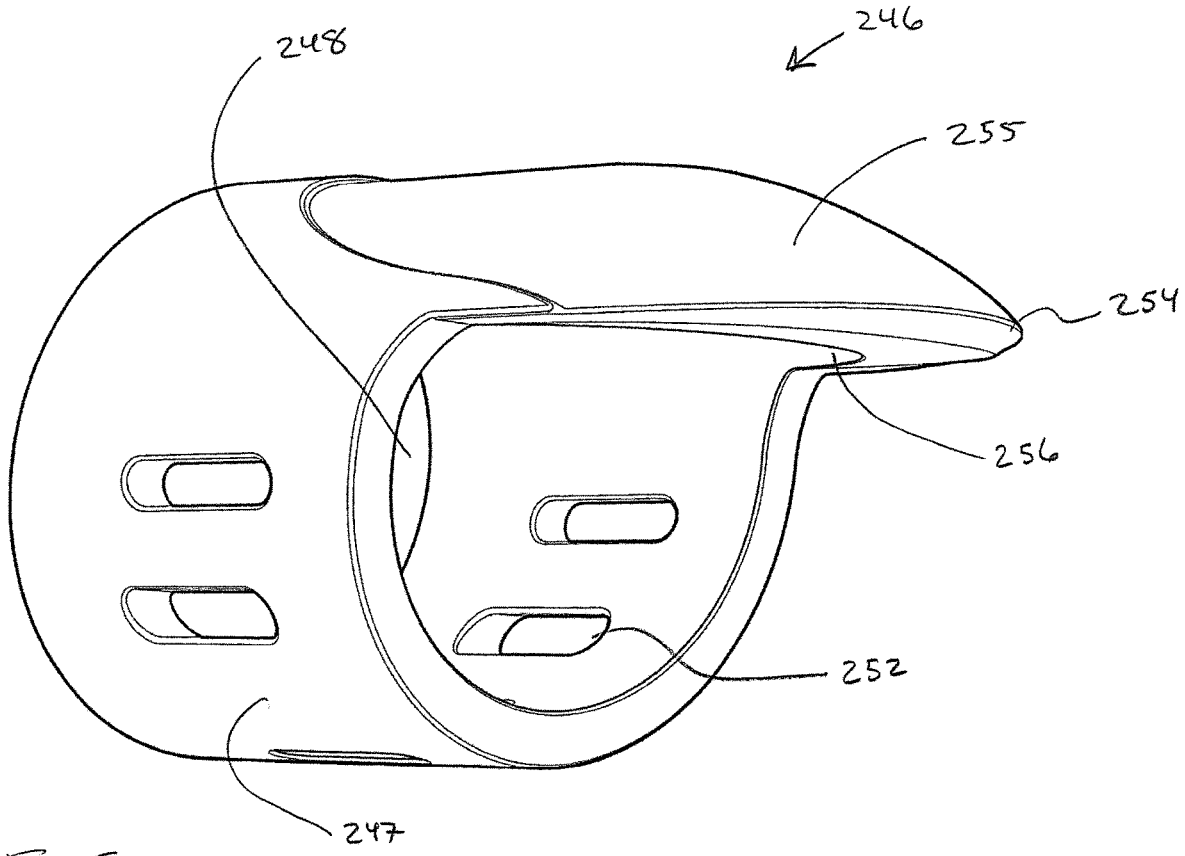

An alternative embodiment of the fingertip covers, indicated in general at 246 in FIGS. 5A-5C, features a generally cylindrical body portion 247 with a central opening 248 that receives the fingertip/distal end of a glove finger portion. Openings 252 permit the fingertip cover to be sewn or otherwise fastened to the fingertip of the corresponding glove finger portion. As for the embodiment of the fingertip cover of FIGS. 2A and 2B, the fingertip cover features a digging tip 254 shaped to facilitate digging into dirt or the like. The digging tip 254 is positioned at the distal end of an overhang portion 255. As illustrated in FIGS. 5A and SC, the underside of the overhang portion 255 features a cup formation 256 to aid the wearer in removing dirt from a hole, channel or the like while digging.

Figure 6A:
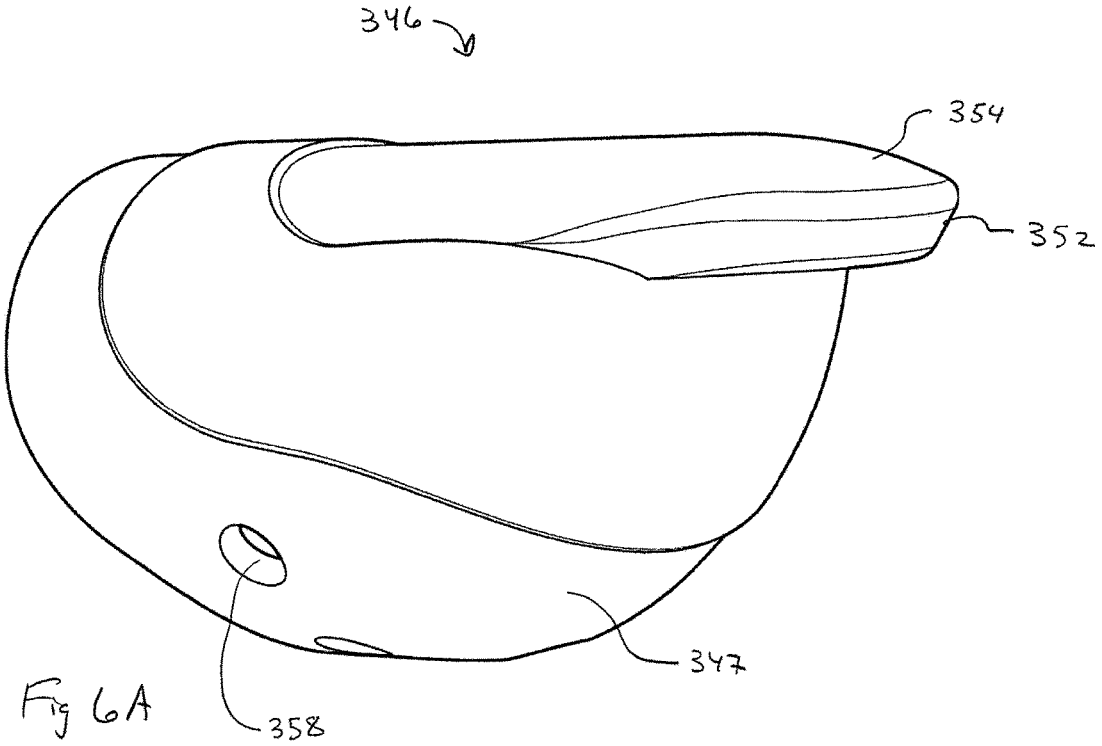
FIGS. 6A-6C are side, back and front perspective views, respectively, of a third embodiment of the fingertip covers of the garden glove of the present invention.
Figure 6B:
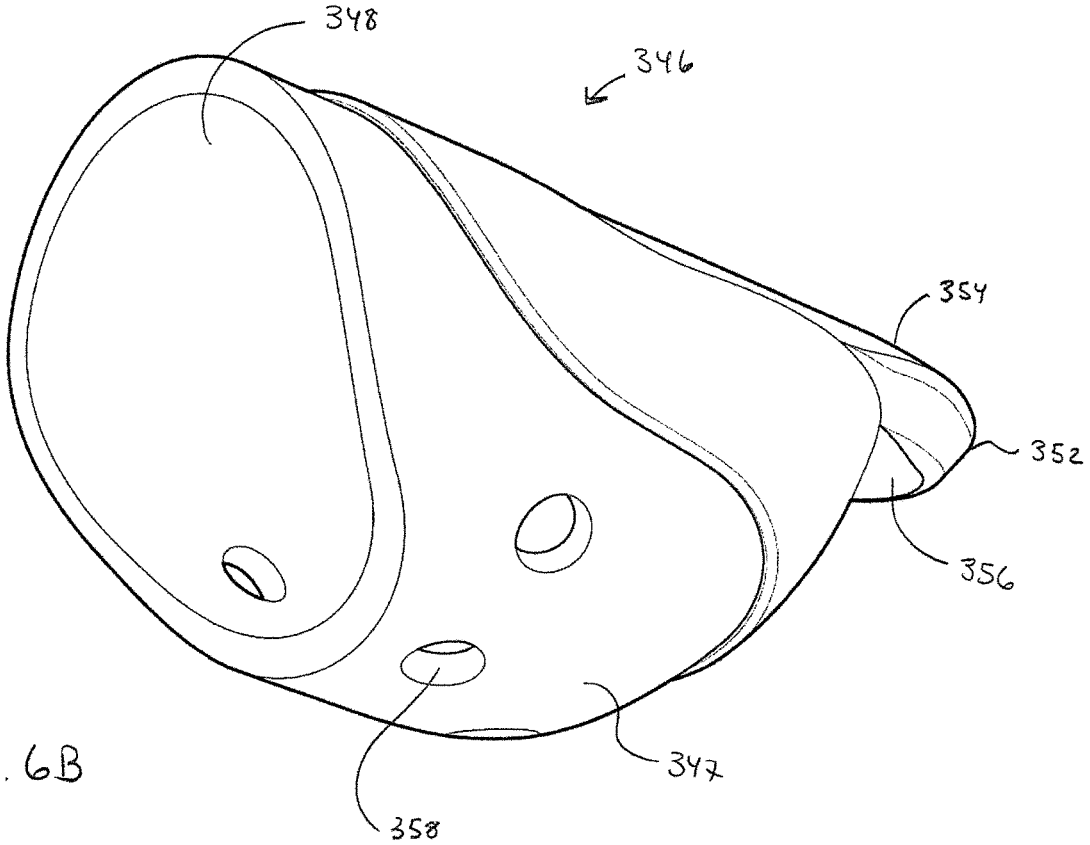
Figure 6C:
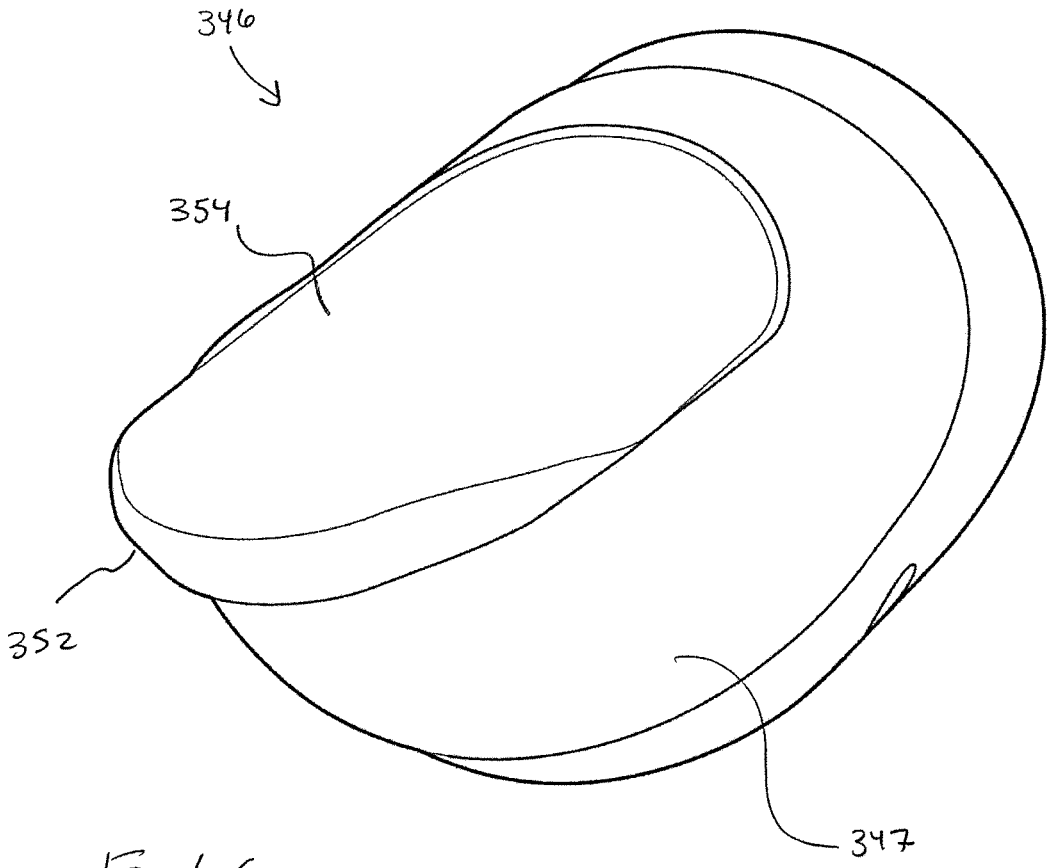

In another alternative embodiment of the fingertip covers, indicated in general at 346 in FIGS. 6A-6C, the fingertip cover features a hollow body 347 with an opening 348 on the back to receive the fingertip of a corresponding glove finger portion. The fingertip cover features a digging tip 352 formed on the distal end of an overhang portion 354. The underside of the overhang portion 354 is cupped, as shown at 356 in FIG. 6B. The body 347 features openings 358 so that the fingertip cover may be sewn or otherwise attached by fasteners to the fingertip of the glove finger portions.

Figure 7A:
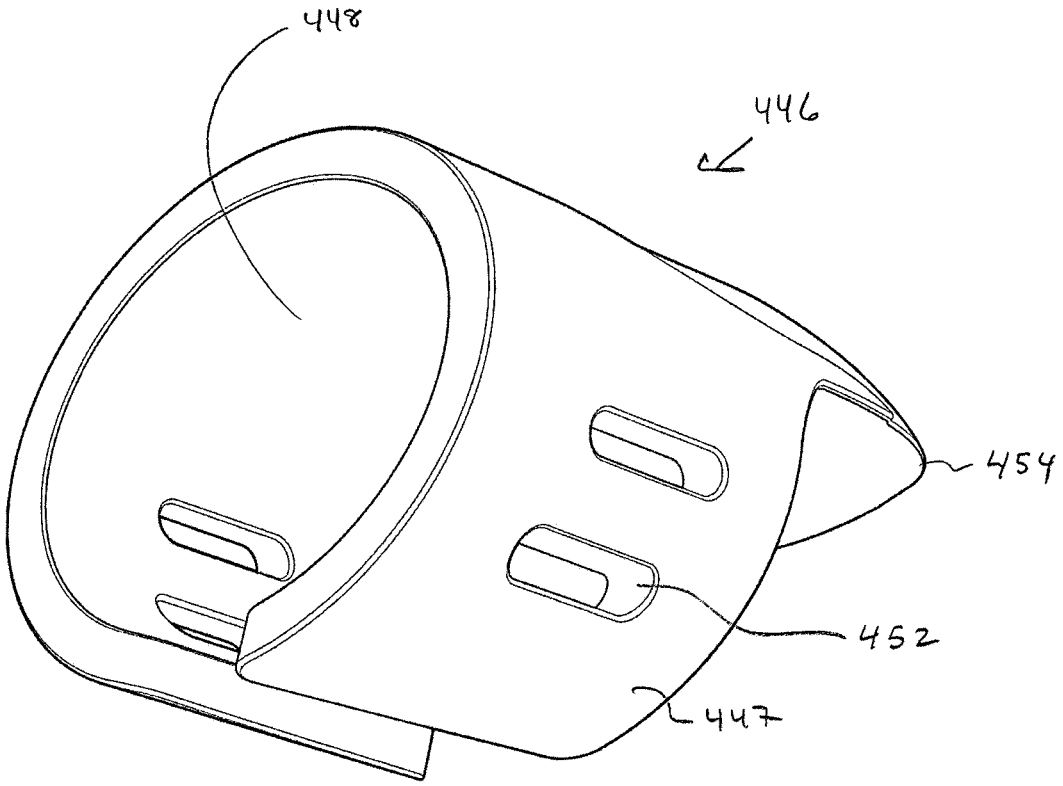
FIGS. 7A-7C are back, top and side perspective views, respectively, of a fourth embodiment of the fingertip covers of the garden glove of the present invention.
Figure 7B:
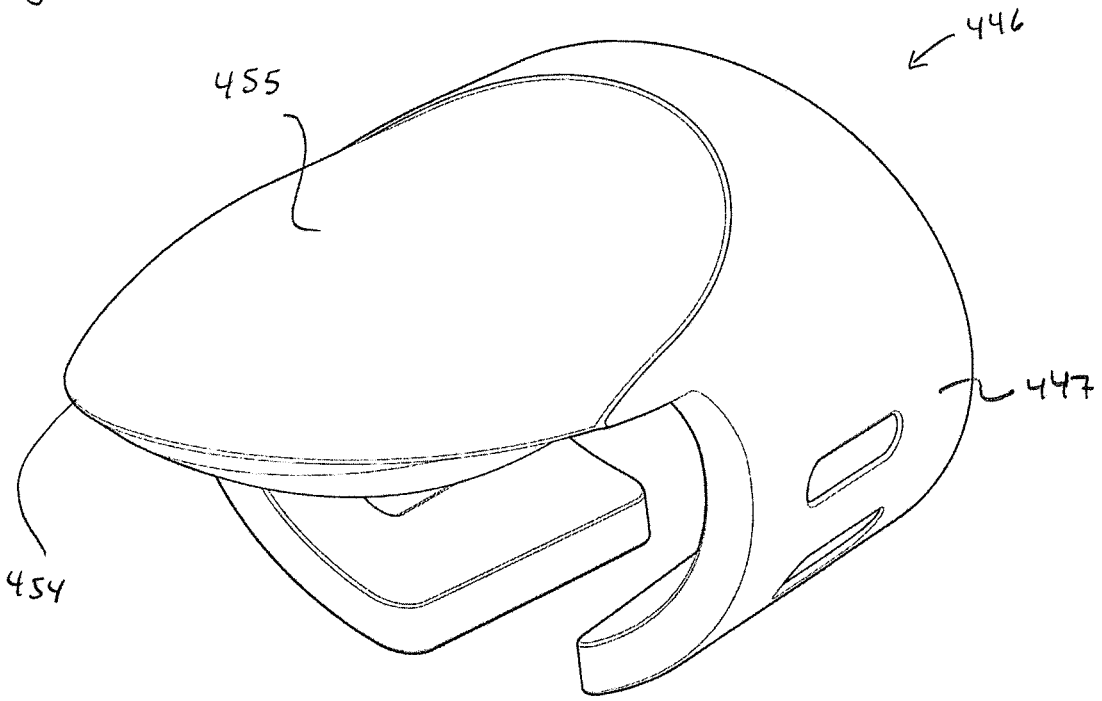
Figure 7C:
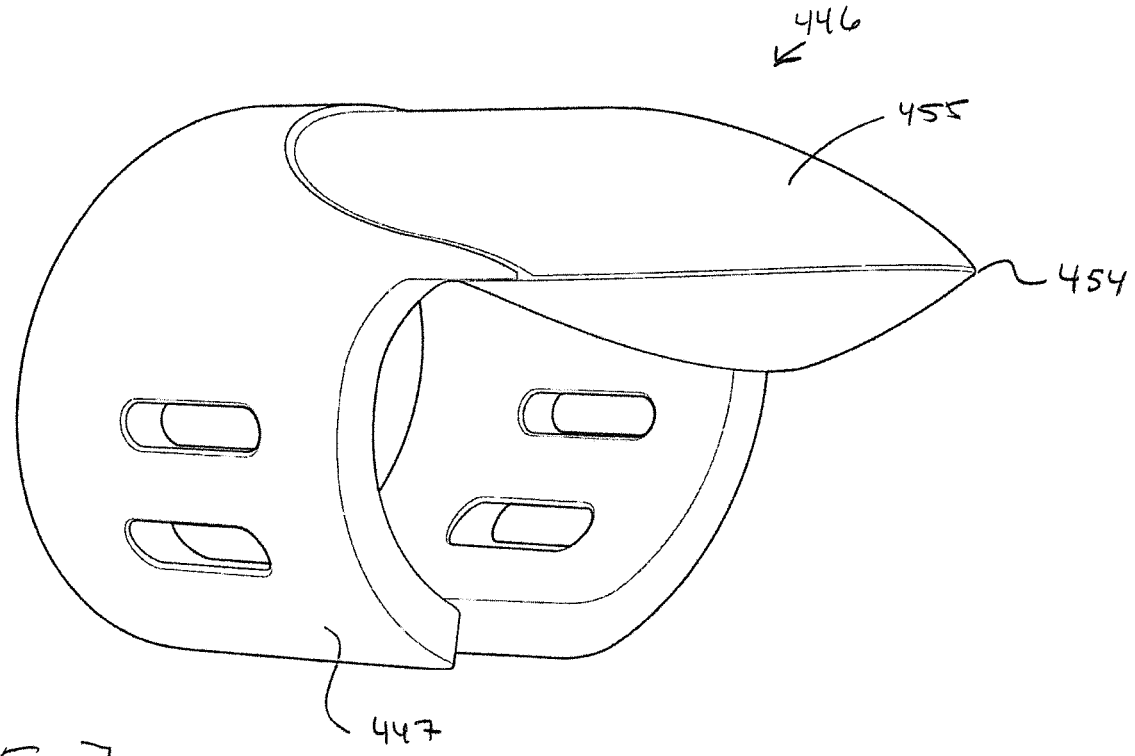

Another alternative embodiment of the fingertip covers, indicated in general at 446 in FIGS. 7A-7C, features a bifurcated generally cylindrical body portion 447 with a central opening 448 that receives the fingertip of a glove finger portion. Openings 452 permit the fingertip cover to be sewn or otherwise fastened to the fingertip of the corresponding glove finger portion. The fingertip cover features a digging tip 454 shaped to facilitate digging into dirt or the like. The digging tip 454 is positioned at the distal end of an overhang portion 455. The underside of the overhang portion 455 is preferably cupped to aid the wearer in removing dirt from a hole, channel or the like while digging.

Figure 8A:
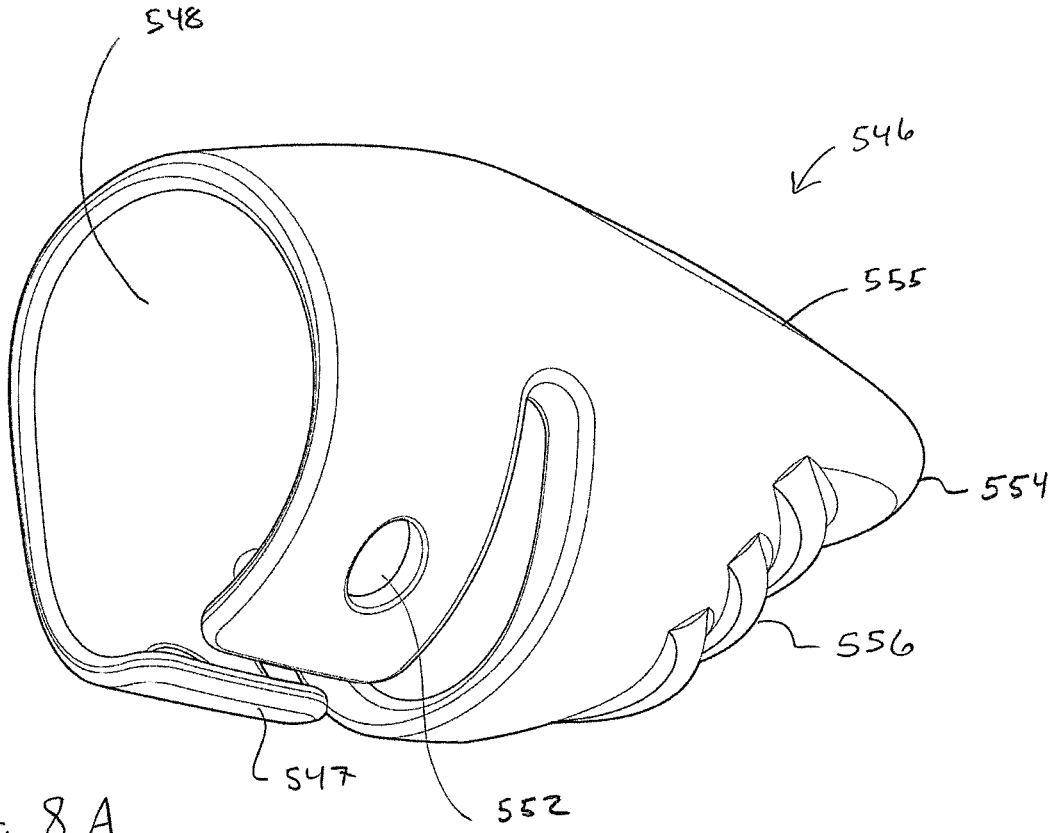
FIGS. 8A-8C are back, top and side perspective views, respectively, of a fifth embodiment of the fingertip covers of the garden glove of the present invention.
Figure 8B:
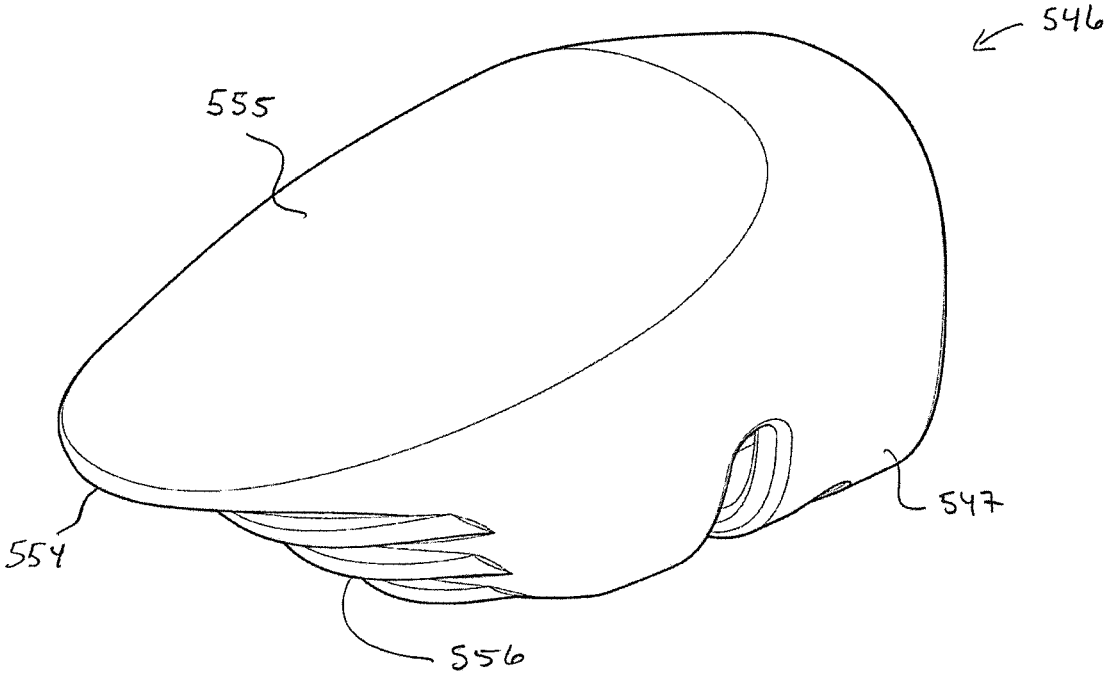
Figure 8C:
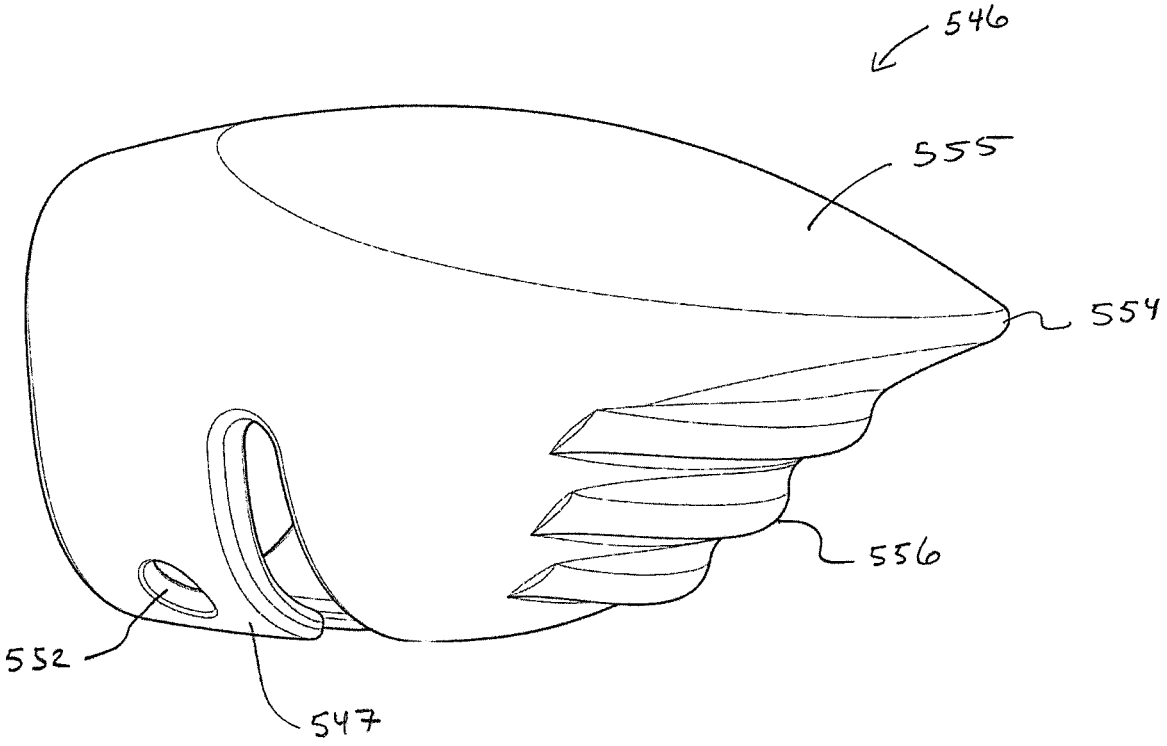

Another alternative embodiment of the fingertip covers, indicated in general at 546 in FIGS. 8A-8C, features a bifurcated generally cylindrical body portion 547 with a central opening 548 that receives the fingertip of a glove finger portion. Openings 552 permit the fingertip cover to be sewn or otherwise fastened to the fingertip of the corresponding glove finger portion. The fingertip cover features a digging tip 554 shaped to facilitate digging into dirt or the like. The digging tip 554 is positioned at the distal end of an overhang portion 555. In addition, a number of ribs 556 are positioned under the digging tip 554. The ribs 556 aid the fingers in withdrawing the dirt from the hole or channel being formed by the wearer.

Figure 9A:
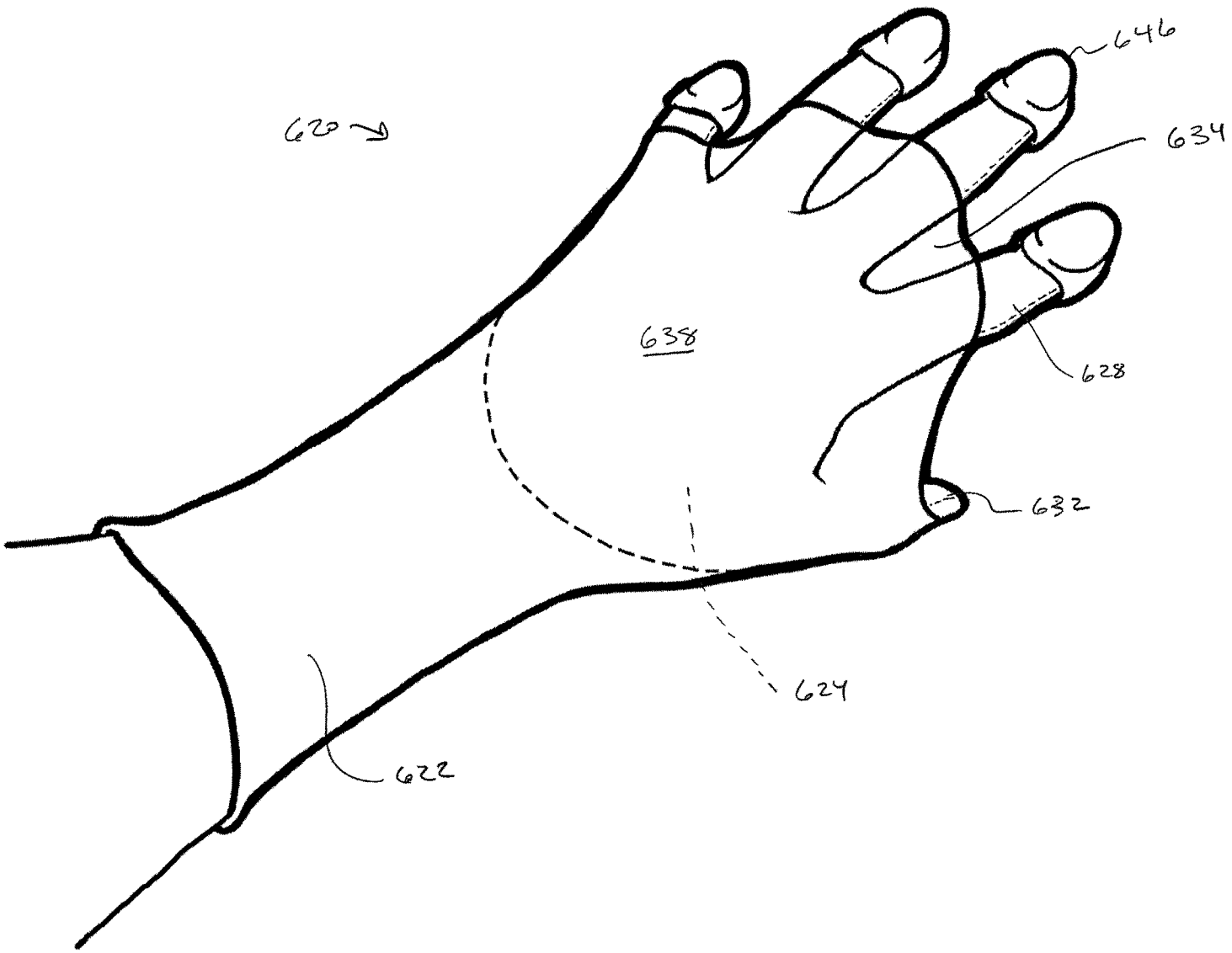
FIGS. 9A and 9B are top and bottom perspective views, respectively, of a second embodiment of the garden glove of the invention.
Figure 9B:
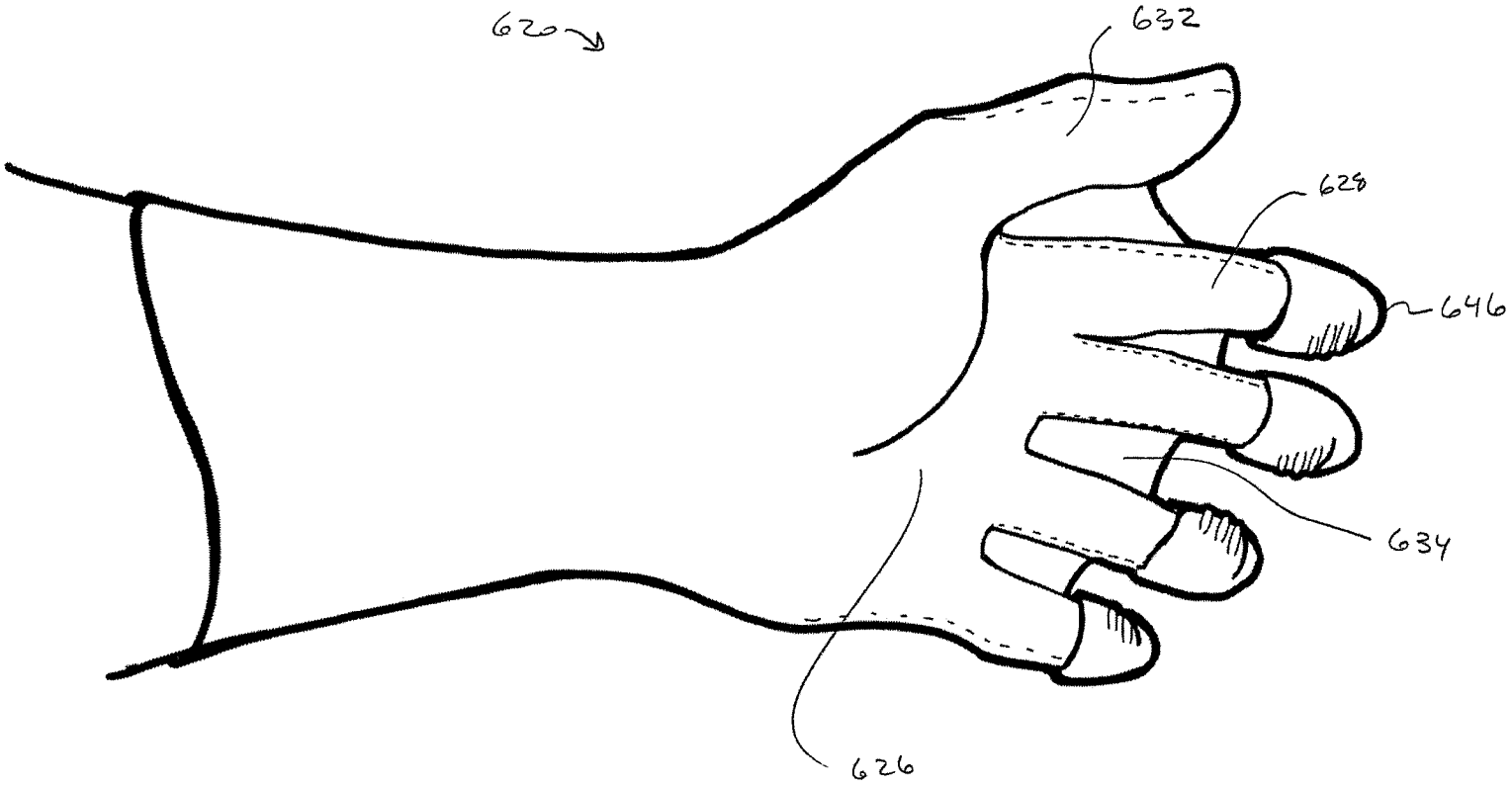

An alternative embodiment of the garden glove of the present invention is indicated in general at 620 in FIGS. 9A and 9B. The glove features a body having a cuff portion 622, a back of hand portion 624, a palm portion 626, finger portions 628 and a thumb portion 632. Extending between each of the finger portions 628 and the thumb portion 632 are webs 634. As for the embodiment of FIGS. 1A and 1B, the glove 620 may be formed from any material known in the art for creating gloves including, as examples only, fabric made from natural (such as cotton) or man-made fibers, rubber or flexible plastic.

In the embodiment shown in FIGS. 9A and 9B, the cuff, back of hand, palm, finger and thumb portions of the glove are formed using a cut and sew method, or any other glove manufacturing technique known in the art. An additional panel of material 638 is attached to the back of hand portion and the backs of the finger portions 628 of the glove 624 by sewing, adhesive or any other fastening arrangement known in the art. The panel 638 is sized to cover at least a portion of the back of hand portion of the glove and to form the webs 634. The panel 638 may be formed from the same material as the remainder of the glove or a different material. As examples only, the panel 638 may be formed from fabric made from natural (such as cotton) or man-made fibers, rubber or flexible plastic.

In alternative embodiments of the glove, the webs may be made of LYCRA® (or other elastic polyurethane fabric), rubberized stretch fabrics and/or fine gauge power mesh. The webs may be secured to the gloves by: a) sewing material individually between finger portions; b) fusing a patch of material to the palm portion of the glove so as to protect the wearer's palms and create webbing between the finger portions; or c) the glove body and webbing may be created as one integrated piece of fabric or material with the webs being delineated from the finger portions via top stitching.

As indicated at 646 in FIGS. 9A and 9B, the distal end of each finger portion 628 is provided with a fingertip cover. The fingertip covers, as explained above, are adapted to enhance the wearer's ability to dig and grasp objects using their fingertips.

Figure 10A:
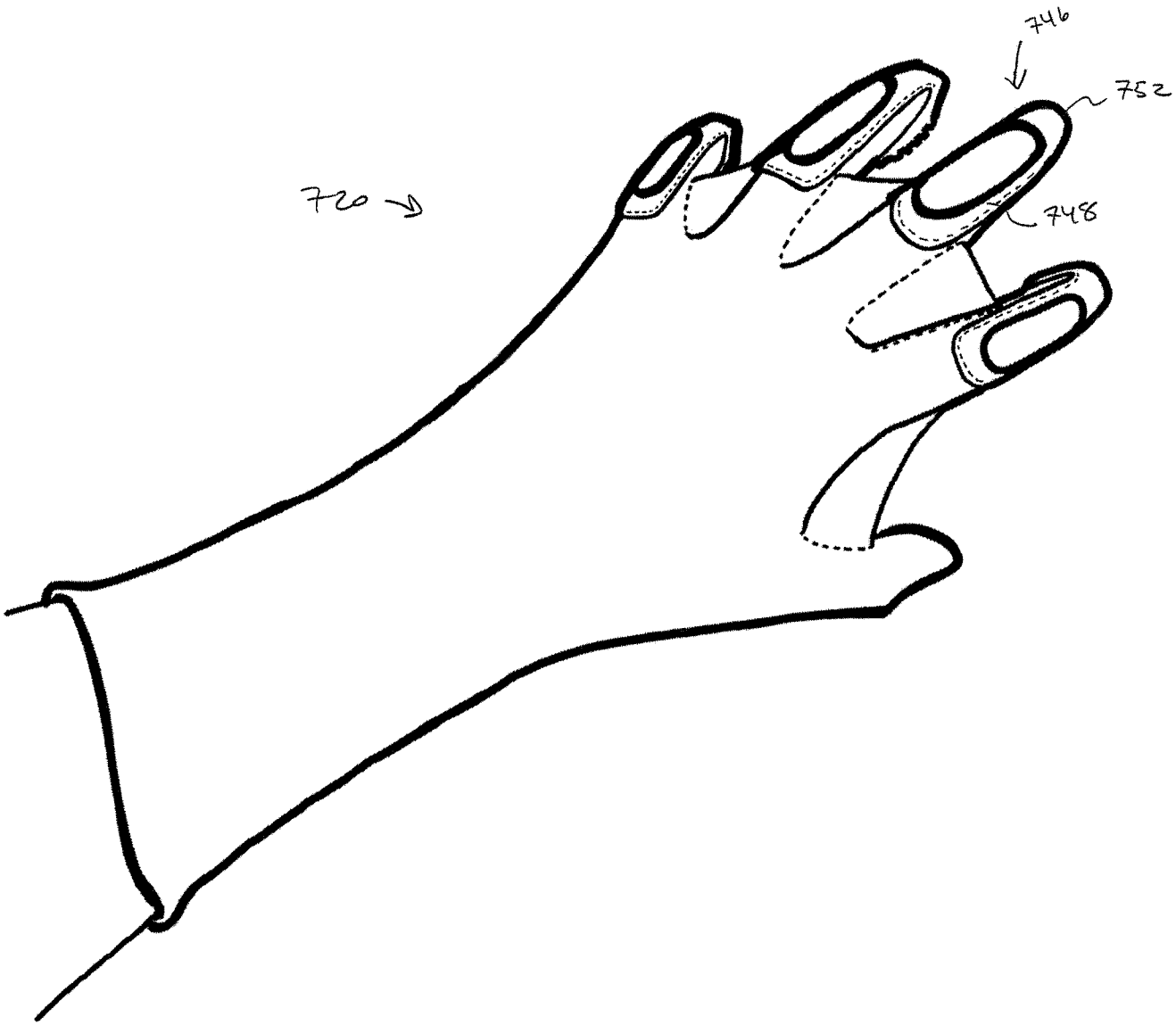
FIGS. 10A-10C are top, bottom and side perspective views, respectively of a third embodiment of the garden glove of the invention.
Figure 10B:
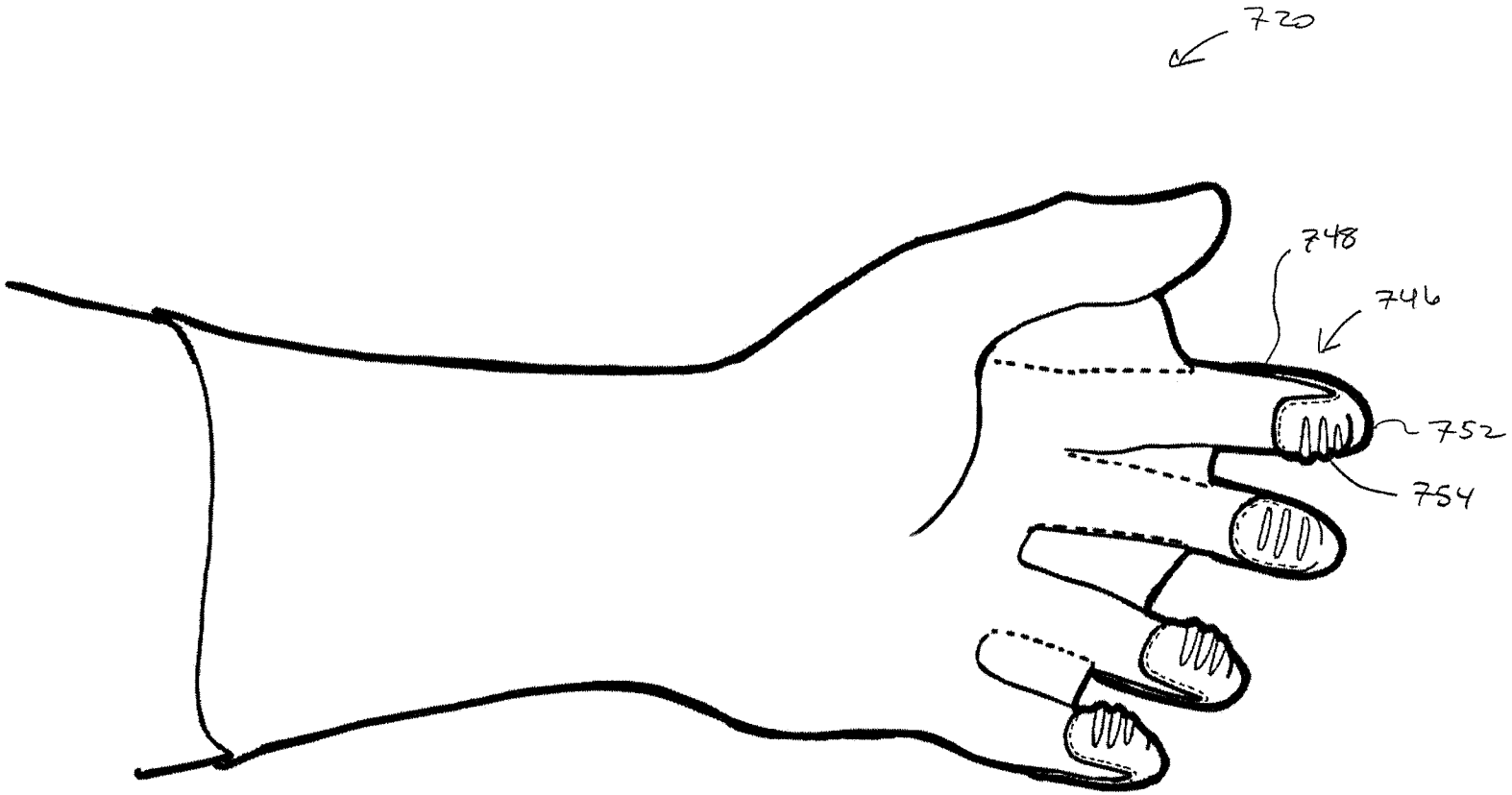
Figure 10C:
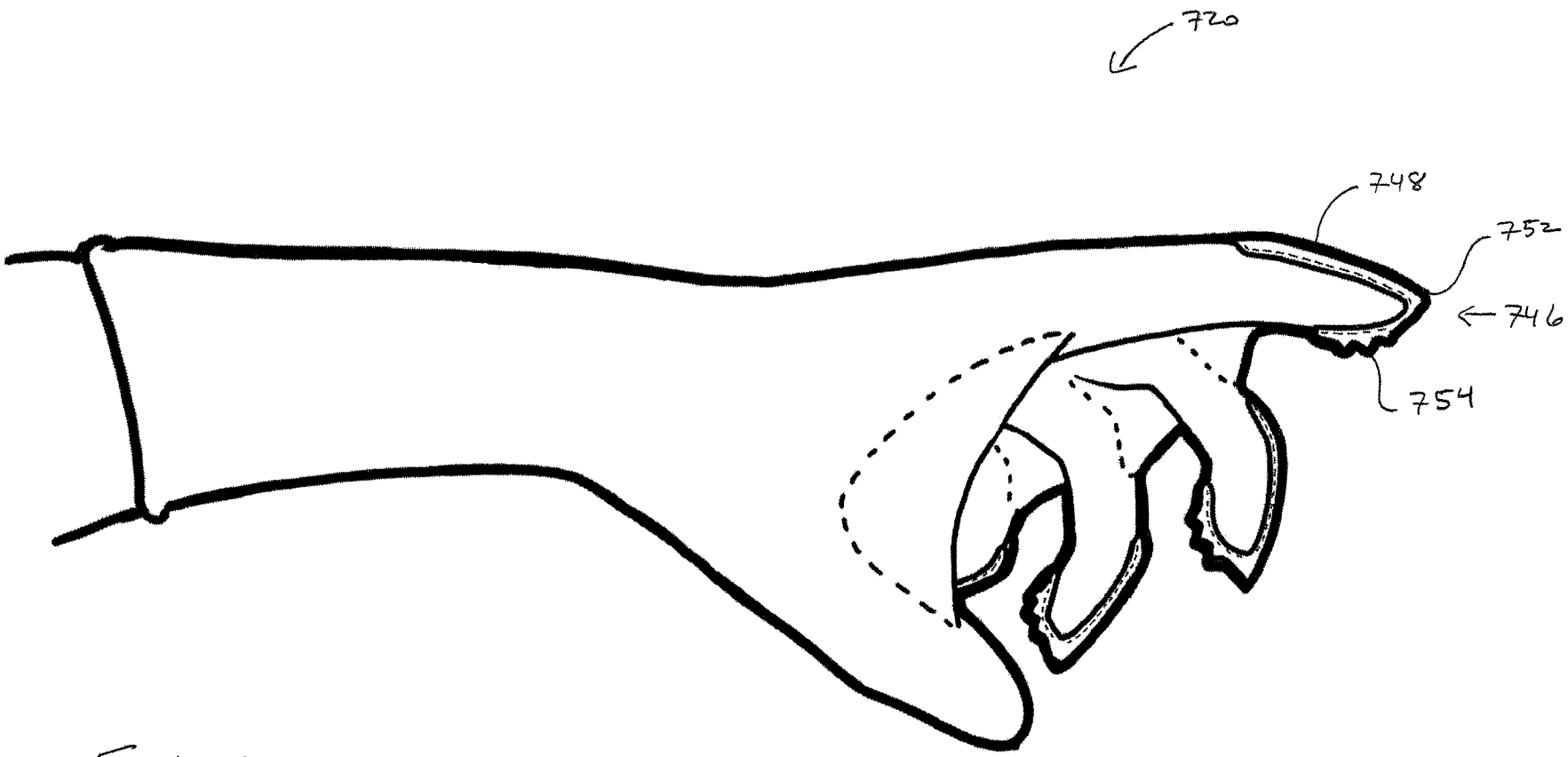

Another embodiment of the garden glove of the invention is indicated in general at 720 in FIGS. 10A-10C. This embodiment features the same construction of the glove of FIGS. 1A and 1B but features fingertip covers 746 that provide additional protection to the back of the wearer's fingers. More specifically, each fingertip cover features an elongated back of finger portion 748 that extends along the back side of the finger portions of the glove. Each fingertip cover 746 also features a digging tip 752 and ribs 754 for the purposes described above.

As in the case of all of the fingertip cover embodiments illustrated above, fingertip covers 746 may be attached to the glove finger portions by sewing, adhesive or any other fastening arrangement or method known in the art or by dipping (such as with, for example, nitrile or latex). In addition, as in the case of any of the fingertip covers described above, the fingertip covers 746 may be constructed from nitrile, latex, plastic, rubber or another durable material that may be molded, shaped or formed.

It should be noted that while the fingertip covers described above are attached to the distal ends of the glove finger portions, the fingertip covers may alternatively be integrally formed with the glove finger portions, and possibly with the rest of the glove. As an example only, the glove could be formed from a plastic or rubber material or the like by a dipping or molding process with the fingertip covers formed along with the glove finger portions and the remainder of the glove.

An alternative embodiment of the glove could have finger portion fingertips/distal ends adapted to receive fingertip covers in a removable fashion, such as by threads, hook and loop fasteners, other types of fasteners or the like. As a result, fingertip covers specifically suited for a use could be fitted to the glove.

In addition, the fingertip covers may be sold separately from the glove as an accessory adapted to be either removably or fixedly attached to the fingertip/distal end portions of the glove finger portions.

Figure 11:
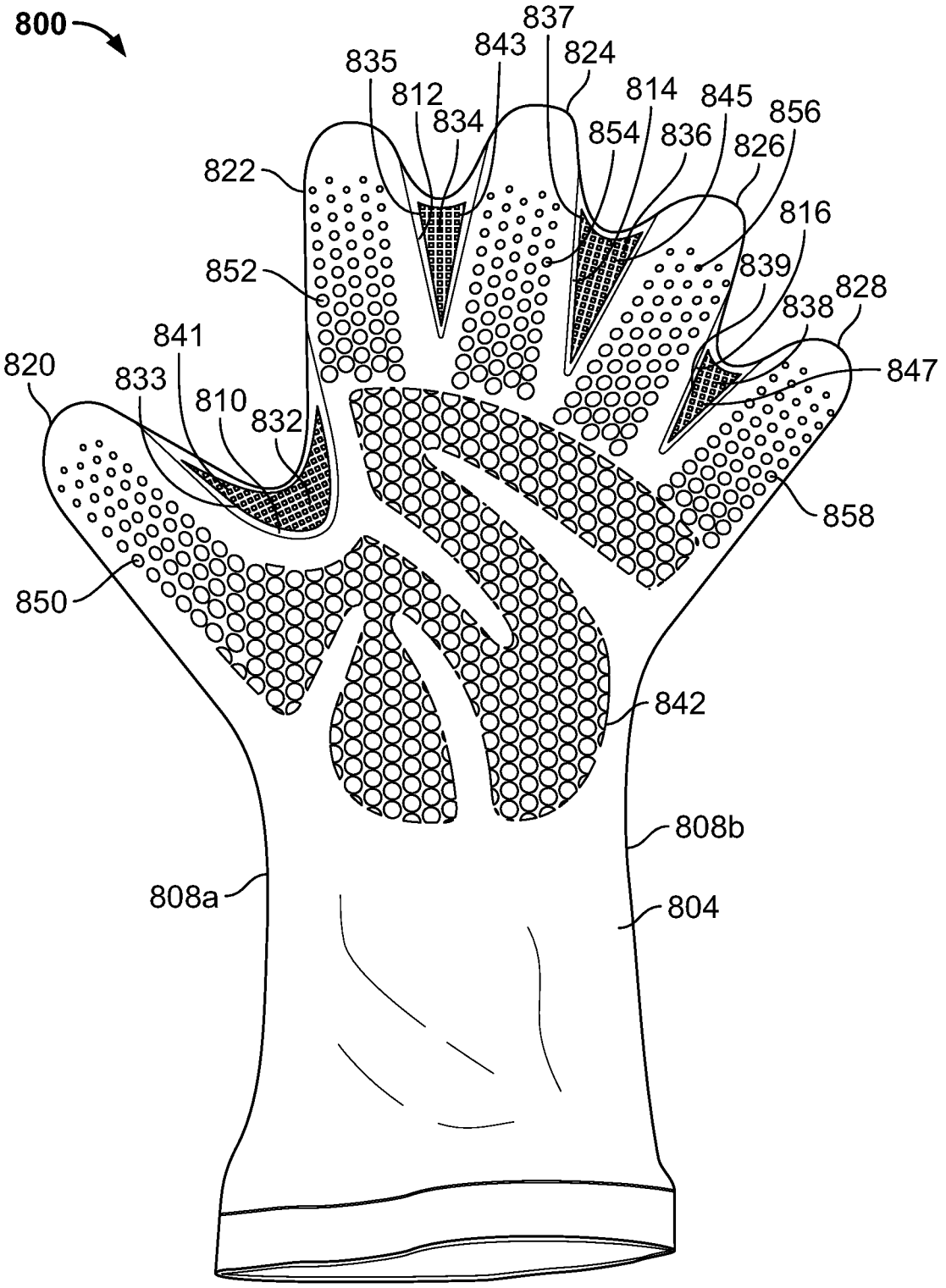
FIG. 11 is a top perspective view of a fourth embodiment of the garden glove of the invention.
Figure 12:
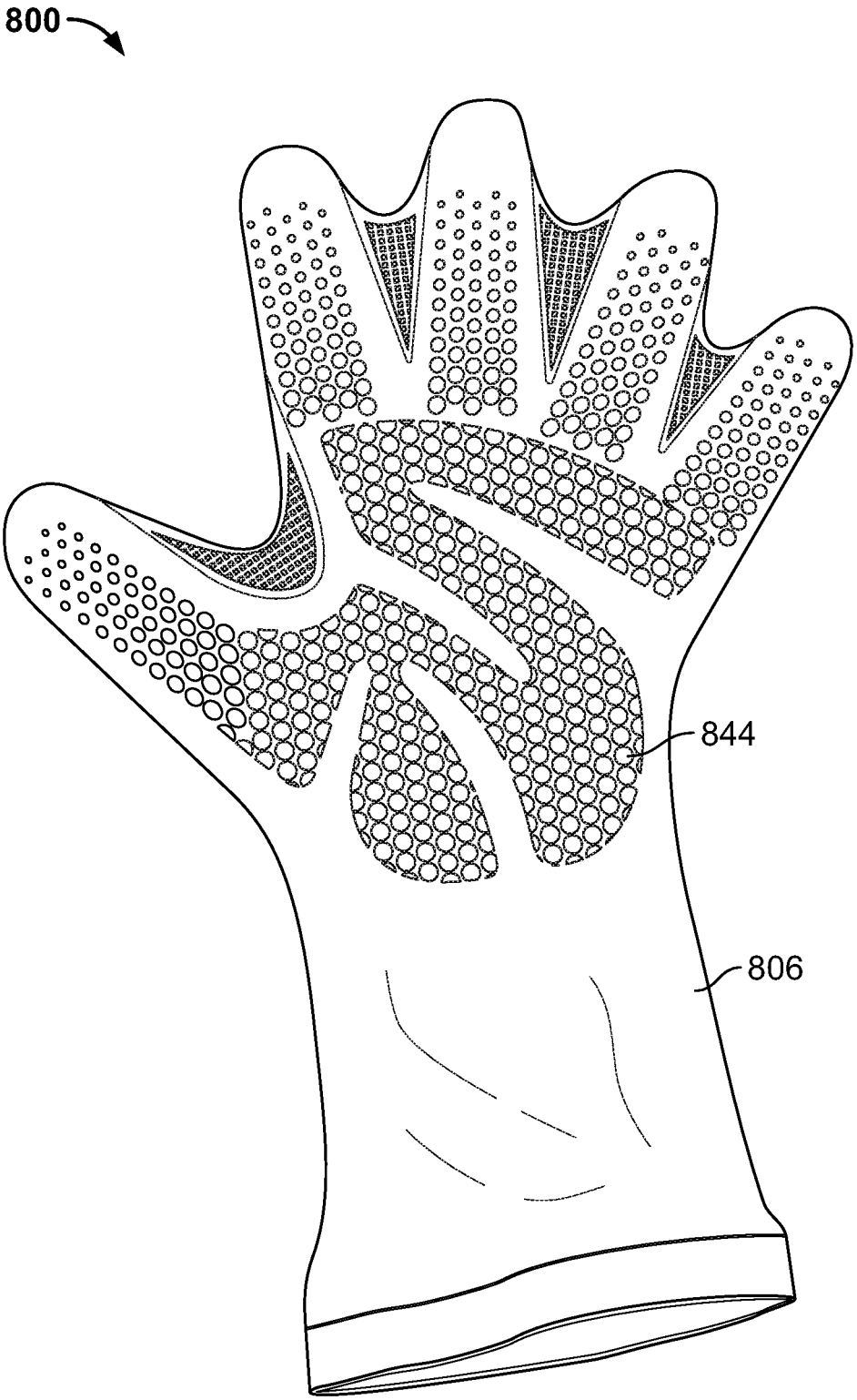
FIG. 12 is a bottom perspective view of the garden glove of FIG. 11.

Another alternative embodiment of the garden glove of the invention is indicated in general at 800 in FIGS. 11 and 12. In this embodiment, the body of the glove, which includes the cuff, the back of hand portion, the palm portion, the finger portion and the thumb portion is formed from two sheets or pieces of fabric (preferably identical), with one piece or sheet indicated at 804 in FIG. 11 and including the palm or back of hand portion, and the other sheet or piece indicated at 806 in FIG. 12 and including the palm or back of hand portion. Pieces 804 and 806 are each preferably formed from LYCRA® (or other elastic polyurethane fabric) and they are sewn or stitched together to form the glove body. More specifically, the two pieces 804 and 806 are sewn or stitched together along the two edges indicated at 808*a* and 808*b* in FIG. 11. In addition, the two pieces 804 and 806 are sewn or stitched together so as to form seams 810, 812, 814 and 816 of FIG. 11 whereby thumb portion 820 and finger portions 822, 824, 824, 826 and 828 are formed with webs 832, 834, 836 and 838 delineated between the adjacent finger portions or thumb portion. After sewing, the glove may be turned inside out so that the stitching along edges 808*a* and 808*b* is inside of the glove and not visible when the glove is worn.

Due to the elastic and flexible nature of the webs, they each expand to form trowels between the finger portions as a user digs in their garden so that efficient removal of dirt is achieved.

As indicated at 842 in FIGS. 11 and 844 in FIG. 12, the back of hand or palm portions of the glove may be provided with patches of a silicone or other gripping material (such as rubber or flexible plastic). The silicone material may be deposited or printed on the fabric pieces 804 and 806 using methods well known in the art. The patch on the palm portion of the glove enhances the users grip. As illustrated in FIGS. 11 and 12, the patches 842 and 844 may feature an "S" or "M" pattern configured so that the silicone is absent on portions of the fabric corresponding to locations of skin folds when the user forms a claw with their hand (such as when digging). This makes it easier for the user to use the glove for digging. In addition, the patches 842 and 844, as illustrated in FIGS. 11 and 12 may be formed by individually formed circles of silicone (or other element shapes) to further increase flexibility of the glove.

As illustrated at 850, 852, 854, 856 and 858 in FIG. 11, the thumb portion and finger portions may also be provided with silicone patches, or patches of other gripping material, to enhance the user's grip. These patches may also be formed from individual circles of silicone (or other element shapes and of other gripping materials). As shown in FIGS. 11 and 12, the diameters of the circular elements of silicone may decrease moving toward the distal tips of the thumb portion and finger portion. This provides users with greater dexterity when bending their fingers.

The webs 832, 834, 836 and 838 may also be provided with a silicone mesh pattern (illustrated in FIGS. 11 and 12) or mesh pattern of other gripping material where, with reference to FIG. 11, the mesh pattern of web gripping material 833, 835, 837 and 839 on each of the webs includes a number of apertures or openings 841, 843, 845 and 847, so that portions of the underlying elastic material are exposed within the mesh pattern, to increase the strength of the webs. The mesh pattern also improves the aesthetics, breathability, and flexibility of the webs (as opposed to using solid silicone patches). The mesh pattern also permits the gloves to dry more quickly if they become wet.

While the preferred embodiments of the invention have been shown and described, it will be apparent to those skilled in the art that changes and modifications may be made therein without departing from the spirit of the invention, the scope of which is defined by the following claims.

What is claimed is:

1. A garden glove comprising a body including a first piece of elastic material and a second piece of elastic material, said first piece of elastic material and said second piece of elastic material being stitched together so that:

a plurality of finger portions are formed with a plurality of finger webs there between, each of said plurality of finger webs being delineated from adjacent finger portions by the stitching;

a thumb portion is formed with a thumb web portion extending between the thumb portion and an adjacent finger portion where the thumb web is delineated from the thumb portion and the adjacent finger portion by the stitching; and a palm portion is provided, wherein a palm patch formed from palm gripping material is deposited on the palm portion, a mesh pattern of web gripping material is deposited on opposite first and second sides of each of the plurality of finger webs and the thumb web, and finger patches formed from finger gripping material are deposited on the finger portions;

said mesh pattern of web gripping material including a plurality of apertures, with each of the plurality of apertures surrounded by web gripping material so that portions of the first piece of elastic material and portions of the second piece of elastic material are exposed through the plurality of apertures.

2. The garden glove of claim 1 wherein said first piece of fabric includes a back of hand portion and said second piece of fabric includes a palm portion and the body includes a cuff.

3. The garden glove of claim 1 wherein each of the plurality of finger portions includes a distal tip and wherein at least one of the plurality of webs does not extend to the distal tip of an adjacent finger portion.

4. The garden glove of claim 1 wherein each of the first and second pieces of elastic material are made of an elastic polyurethane.

5. The garden glove of claim 1 wherein the palm gripping material, the web gripping material and the finger gripping material all include silicone.

6. The garden glove of claim 5 wherein the palm patch is formed from a plurality of elements of palm gripping material.

7. The garden glove of claim 1 wherein the finger gripping material of the finger patches is silicone.

8. The garden glove of claim 1 wherein the mesh pattern of web gripping material is silicone.

9. The garden glove of claim 1 wherein the palm patch formed from palm gripping material features an S-shaped or an M-shaped pattern configured so that palm gripping material is absent on elongated portions of elastic material of the palm portion corresponding to locations of a user's hand skin folds when the user forms a claw with his or her hand.

10. The garden glove of claim 9 wherein at least one of the elongated portions of elastic material from which palm gripping material is absent has an arcuate shape.

* * * * *